US006228568B1

(12) United States Patent
Stetzer et al.

(10) Patent No.: US 6,228,568 B1
(45) Date of Patent: May 8, 2001

(54) COLOR PHOTOGRAPHIC RECORDING MATERIAL

(75) Inventors: Thomas Stetzer, Langenfeld; Hans Langen, Bonn; Heinz Schütz, Leverkusen; Hans-Joachim Schumann, Köln; Klaus Sinzger; Johannes Willsau, both of Leverkusen; Dirk Hübner, Köln; Engelbert Wiel, Leverkusen, all of (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/461,476

(22) Filed: Dec. 14, 1999

(30) Foreign Application Priority Data

Dec. 21, 1998 (DE) ..... 198 58 999

(51) Int. Cl.[7] ..... G03C 7/32; G03C 7/392; G03C 7/30; G03C 1/825; G03C 1/91

(52) U.S. Cl. ..... 430/504; 430/214; 430/507; 430/551

(58) Field of Search ..... 430/504, 507, 430/551, 214

(56) References Cited

U.S. PATENT DOCUMENTS 2,927,019 * 3/1960 Woodward et al. ..... 430/504
5,776,667 * 7/1998 Ohlschlager et al. ..... 430/507
6,017,689 * 1/2000 Bell et al. ..... 430/504
6,033,841 * 3/2000 Bell et al. ..... 430/504

* cited by examiner

*Primary Examiner*—Richard L. Schilling
(74) *Attorney, Agent, or Firm*—Connolly Bove Lodge & Hutz LLP

(57) ABSTRACT

The present invention relates to a color photographic recording material which contains, in at least one layer between the substrate and light-sensitive emulsion layer situated nearest to the substrate, a compound of formula (I)

wherein

X and Y, independently of each other in each case, represent an electron-attracting group, and X and Y together can form a group which is necessary for the completion of a 5- or 6-membered ring.

13 Claims, No Drawings

COLOR PHOTOGRAPHIC RECORDING MATERIAL

The present invention relates to a colour photographic recording material which contains, in at least one layer between the substrate and the light-sensitive emulsion layer situated nearest to the substrate, a compound of formula (I)

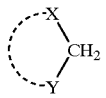

wherein

X and Y, independently of each other in each case, represent an electron-attracting group, and X and Y together can form a group which is necessary for the completion of a 5- or 6-membered ring.

If the spectral composition of the light which is incident on a light-sensitive photographic silver halide emulsion layer has to be checked or controlled, a coloured layer can be incorporated in the light-sensitive photographic recording material for this purpose, and this layer is then termed a filter layer. Thus in colour photographic materials, for example, a yellow coloured filter layer is generally disposed between the blue-sensitive layer and the green-sensitive and red-sensitive layers situated below the blue-sensitive layer, in order to keep blue light away from the green- and red-sensitive layers.

Stringent demands are made on dyes used in photographic materials. They not only have to exhibit a suitable spectral absorption corresponding to their purpose of use, but should also be photochemically inert. In particular, these dyes must have no disadvantageous effects on the quality of the photographic silver halide emulsion; thus they must not, for example, depress the film speed or give rise to the formation of fogging. Moreover, although the dyes in the material should be resistant to diffusion, they have to be completely and irreversibly decolorised or washed out of the layer during the processing of the material, so that no unwanted coloration remains on the exposed, developed photographic material. Furthermore, the dyes themselves should be stable on storage and should not give rise to any change in the photographic material during storage.

These requirements are not fulfilled to a satisfactory extent by known dyes. The colloidal silver which is usually employed in yellow filter layers readily gives rise to the formation of fogging in adjacent emulsion layers. Water-soluble organic dyes which are rendered diffusion-resistant by the introduction of long alkyl chains, such as those disclosed in DE 22 59 746 for example, are not decolorised or are only incompletely decolorised in normal photographic processing baths. When dyes are fixed with a mordant, as in GB 1 034 044, U.S. Pat. No. 3,740,228 or DE-A-29 41 819 for example, the effect of the mordant is generally insufficient to fix the dye to the requisite extent in the mordant layer.

Condensation products of 3-alkylisoxazolones with p-N, N-Bis-carbalkoxy-methyl-aminobenzaldehydes or N-carbalkoxyethylcarbazol-3-aldehydes (arylidene dyes) are known from DE 196 46 402 which exhibit a suitable absorption for use as yellow filter dyes and which are completely decolorised in the layer during development.

It has been shown, however, that even the yellow filter dyes according DE 196 46 402, which do in fact exhibit a good capacity for decolorisation, possess a stability on storage, particularly on polyester substrates, which is unsatisfactory under normal conditions of storage. Normal storage in this respect is to be understood as storage with the exclusion of light and in atmospheric conditions corresponding to room temperature (i.e. in the region of 15 to 30° C.). An appreciable decrease in green-sensitivity can be observed in the course of storage.

Unsatisfactory stability of the latent image often occurs. This is manifested by a change in the sensitometric properties of the materials during storage after exposure compared with a material which is developed directly after exposure. Thus, for example, changes occur in speed, in contrast, in colour match and in colour reproduction. Since for photographic film recording materials there is generally an interval from several days to several weeks between the exposure of the material and the development thereof, good latent image stability is important for these materials.

The underlying object of the present invention is to provide a colour photographic recording material which contains a readily decolorisable yellow filter layer and which exhibits improved stability on storage. The object in particular is to improve the stability on storage of polyester-based materials. At the same time, the object is to achieve good blue-green colour separation.

Surprisingly, it has been found that an improved stability on storage can be achieved with yellow filter dyes which are known from the prior art, particularly those which are known from DE 196 46 402, by adding a compound of formula (I) to at least one layer between the substrate and the light-sensitive layer which is situated nearest to the substrate. It has thereby proved possible to achieve a sensitivity to green which is stable during normal storage. It has proved possible at the same time to achieve an improvement in latent image stability.

The present invention relates to a colour photographic recording material which contains, on a film base, at least one red-sensitive silver halide emulsion layer comprising a cyan coupler, at least one green-sensitive silver halide emulsion layer comprising a magenta coupler, at least one blue-sensitive silver halide emulsion layer comprising a yellow coupler, and at least one yellow coloured, light-insensitive layer (yellow filter layer) which is disposed below a blue-sensitive silver halide emulsion layer and above a green-sensitive silver halide emulsion layer, characterised in that the material contains, in at least one layer between the substrate and the light-sensitive emulsion layer situated nearest to the substrate, a compound of formula (I)

(I)

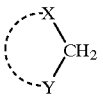

wherein

X and Y, independently of each other in each case, represent an electron-attracting group, and X and Y together can form a group which is necessary for the completion of a 5- or 6-membered ring.

Said compounds are preferably open-chain or (hetero) cyclic ketomethylene compounds of general formula (Ia) or of the corresponding tautomeric formula (Ib)

(Ia)

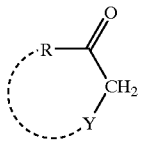

(Ib)

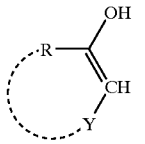

wherein

Y represents an electron-attracting group and

R represents alkyl, aryl, alkoxy, aryloxy, alkylamino, arylamino or together with Y represents a group for the completion of a 5- or 6-membered ring (hetero)cycle.

The compound of formula (I) is used in an amount from 0.01 to 10 mmole/$m^2$, preferably from 0.1 to 2 mmole/$m^2$. In the sense of the present Application, either one compound only can be used, or a mixture of different compounds of formula (I) can be used.

The compounds according to the invention and the synthesis thereof are known from the literature.

Examples of electron-attracting groups in the sense of the present invention include R'CO—, R'R"NCO—, NC—, R'$SO_2$—, R'OCO— and R'R"$NSO_2$. In one preferred embodiment corresponding to formula (Ia) (formula (Ia) is also to be understood hereinafter as comprising the tautomeric form corresponding to formula (Ib)), X represents —RCO and Y represents an electron-attracting group. R' and R", independently of each other, can represent the radicals cited above for R. Other groups which are preferred in the sense of the present Application are described by March, in Advanced Organic Chemistry, 3rd Ed., page 17 and page 238.

In another preferred embodiment, R and Y according to formulae Ia or Ib together form a group for the completion of a 5 or 6-membered ring. Said ring can be either a heterocycle or a ring without hetero atoms. Pyrazolone, isoxazolone and pyrazolidine dione are examples of rings which are preferably formed.

Alkyl in the sense of the present Application is to be understood to mean linear or branched, cyclic or straight chain, substituted or unsubstituted hydrocarbon radicals, and in particular comprises alkyl groups containing 1 to 12 C atoms, such as methyl, ethyl, propyl, isopropyl, butyl, t-butyl, neopentyl and 2-ethylhexyl groups. These can be further substituted, however, most preferably with a carboxycarbonyl group.

Aryl in the sense of the present Application is to be understood to mean aromatic hydrocarbon groups, wherein these are preferably 5- to 6-membered ring systems which can exist in monocyclic form or which can also exist as condensed ring systems. These ring systems may be either substituted or unsubstituted. The term "aryl" in the sense of the present Application is also to be understood to mean hetaryl systems. These are aromatic systems which contain at least one hetero atom. They are also preferably 5- and 6-membered ring systems which can exist in monocyclic form or which can also exist as condensed ring systems. These ring systems may be either substituted or unsubstituted. N, S and O are hetero atoms which are particularly suitable. A ring system preferably contains between 1 and 3 hetero atoms, where the latter may be the same or different hetero atoms. In condensed ring systems, a plurality of identical or different heterocyclic systems can be condensed, as can hetaryl systems with aryl systems.

Aryloxy in the sense of the present Application is to be understood to mean the groups defined above under "aryl" which are bonded to a radical via an oxygen atom.

Alkoxy in the sense of the present Application is to be understood to mean the groups defined above under "alkyl" which are bonded to a radical via an oxygen atom.

Alkylamino in the sense of the present Application is to be understood to mean the groups defined above under "alkyl" which are bonded to a radical via an amino group.

Arylaniino in the sense of the present Application is to be understood to mean the groups defined above under "aryl" which are bonded to a radical via an amino group.

Typical compounds of formula (I) which are preferably used according to the invention include compounds A listed below:

A-1

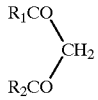

A-2

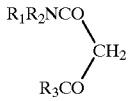

A-3

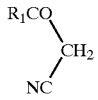

A-4

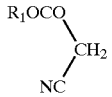

A-5

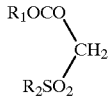

A-6

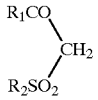

A-7

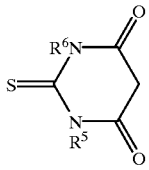

A-8

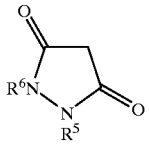

-continued
A-9
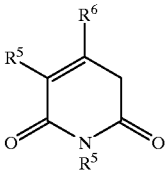
A-10
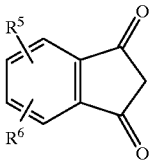
A-11
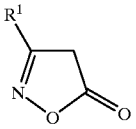
A-12
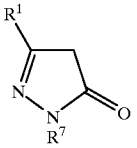
A-13
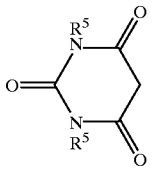
A-14
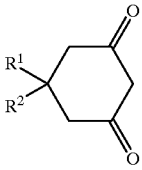
A-15
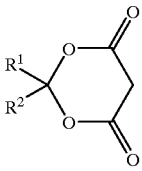
A-16
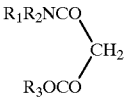
A-17
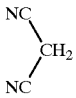
A-18
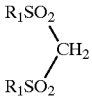
-continued
A-19
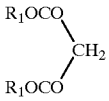
A-20
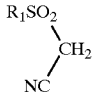
A-21
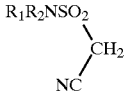
A-22
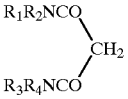
A-23
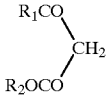
A-24
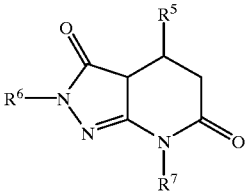
A-25
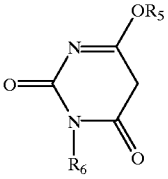
A-26
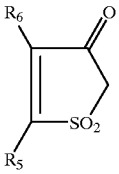
A-27
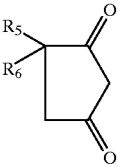
A-28
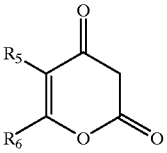

-continued

A-29

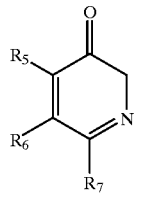

A-30

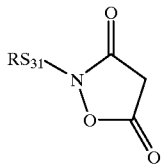

A-31

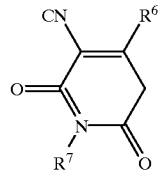

In the above formulae A1 to A31, the $R^1$, $R^2$, $R^3$ and $R^4$ radicals, independently of each other in each case, each represent an alkyl group, an aryl group, a heterocyclic group or an alkenyl group. The $R^5$, $R^6$ and $R^7$ radicals, likewise independently of each other, each represent a hydrogen atom or a substituent. The preferred substituents in the sense of the present Application include alkyl groups containing 1 to 40 carbon atoms, such as methyl, ethyl, propyl, isopropyl, butyl, tertiary butyl, hexyl, octyl and 2-hydroxy-ethyl groups for example, as well as alkoxy groups containing 1 to 40 C atoms such as methoxy, ethoxy or butoxy for example, and additionally include halogen atoms, for example chlorine, bromine or fluorine only, and also include mono- or dialkylated amino groups containing 1 to 20 carbon atoms in the alkyl groups wherein the alkyl groups may be substituted, such as dimethylamino, diethylamino and cyanoethylamino for example, ester groups containing 2 to 20 carbon atoms, such as methoxycarbonyl, ethoxycarbonyl and phenoxycarbonyl for example, amido groups, such as acetylamino and benzamino for example, carbamyl groups containing 1 to 20 carbon atoms, such as methylcarbamoyl and ethylcarbamoyl for example, sulphamoyl groups containing 0 to 20 carbon atoms, such as methylsulphamoyl and butylsulphamoyl for example, aryl groups containing 6 to 10 carbon atoms, such as phenyl, napthyl, 4-methoxyphenyl and 3-methylphenyl for example, acyl groups containing 2 to 20 carbon atoms, such as acetyl, benzoyl or propanoyl for example, sulphonyl groups containing 1–20 carbon atoms, such as methanesulphonyl or benzenesulphonyl for example, ureido groups containing 1 to 20 carbon atoms, such as ureido or methylureido for example, urethane groups containing 2 to 20 carbon atoms, such as methoxycarbonylamino or ethoxycarbonylamino for example, sulphonate groups, such as methoxysulphonyl or phenoxysulphonyl for example, cyano groups, hydroxyl groups, nitro groups, and heterocyclic groups, such as benzoxazole, pyridine or furane for example. The alkyl radical represented by $R^1$, $R^2$, $R^3$ and $R^4$ can be an alkyl group containing 1 to 40 carbon atoms, such as for example methyl, ethyl, benzyl, phenethyl, propyl, butyl, isobutyl, pentyl, hexyl, octyl or nonyl for example, which can optionally comprise substituents. The latter can include the aforementioned substituents. As aryl groups, the $R^1$, $R^2$, $R^3$ and $R^4$ radicals preferably represent an aryl group containing 6 to 10 carbon atoms, such as phenyl or naphthyl for example, which can likewise be substituted by the aforementioned substituents. A heterocyclic group represent by $R^1$, $R^2$, $R^3$ or $R^4$ is preferably a 5- or 6-membered ring, and may for example be an oxazole ring, a benzoxazole ring, a thiazole ring, an imidazole ring, a pyridine ring, a furane ring, a thiophene ring, a sulpholane ring, a pyrazole ring, a pyrrole ring, a chromane ring or a coumarin ring, which can likewise be substituted by the aforementioned substituents. As alkenyl groups, $R^1$, $R^2$, $R^3$ or $R^4$ preferably represent an alkenyl group containing 2 to 10 carbon atoms, such as vinyl, allyl, 1-propenyl, 2-pentenyl or 1,3-butadienyl for example. As mentioned above, two of the $R^1$ to $R^7$ substituents in each case can be bonded to each other and can thus form a ring system. The latter is preferably a 5- or 6-membered ring system, such as a pyrrolidine ring, a piperidine ring, a morpholine ring or a benzene ring for example.

Compounds which are particularly preferred in the sense of the present invention are A-8, A-11, A-12, A-13, A-15 and A-31.

The following compounds are most particularly preferred:

(I-1)

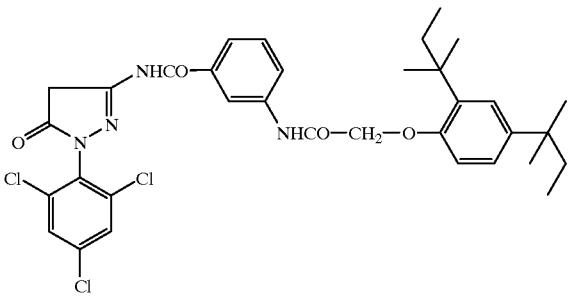

(I-2)

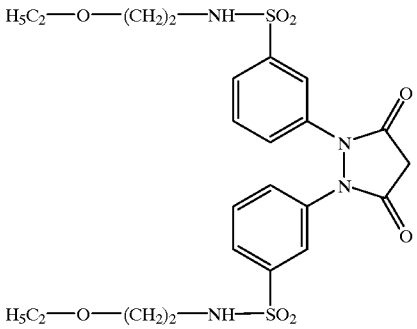

-continued
(I-3)
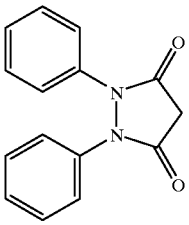
(I-4)
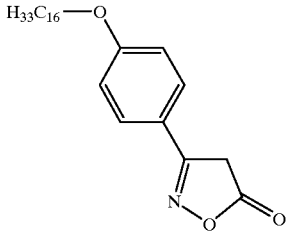
(I-5)
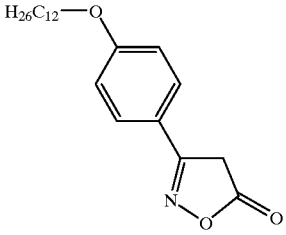
(I-6)
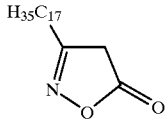
(I-7)
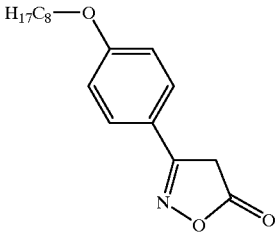
(I-8)
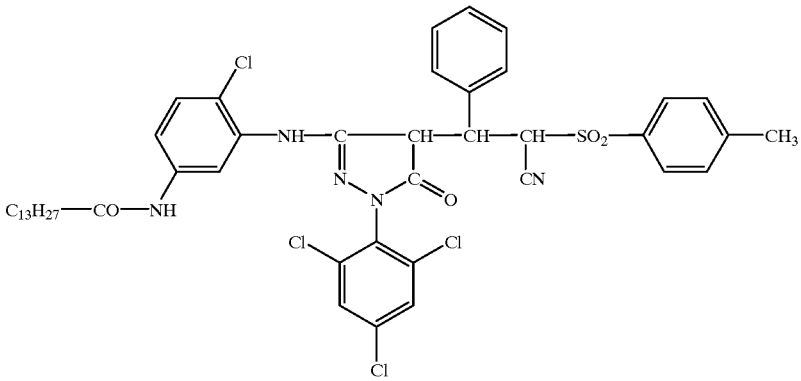
(I-9)
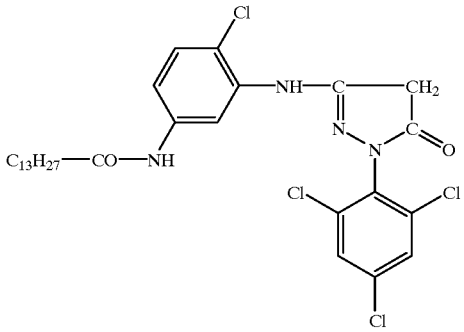
(I-10)
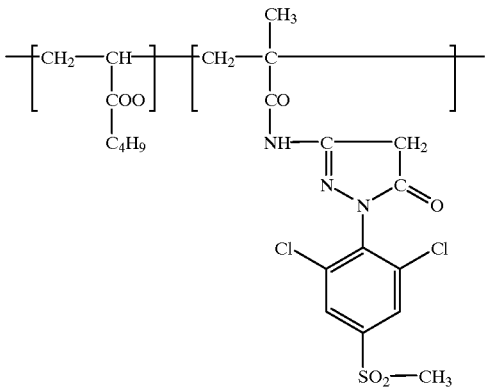
80% 20%

-continued (I-11)

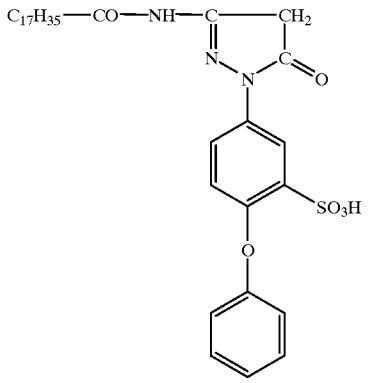

According to the invention, compounds of formula (I) are preferably contained at least in any light-insensitive layer between the substrate and the light-sensitive emulsion layer situated nearest to the substrate. Compounds of formula (I) can thus either be added to an already existing layer, or can be introduced as such into a separate layer in the material. When they are introduced in the form of a separate layer, this layer is usually a layer consisting of a hydrophilic colloid, preferably gelatine. The compound can be introduced, for example, in high boiling organic solvents, as a finely divided dispersion of a solid, or as a filled latex, by methods known from the prior art. According to the invention, compounds of formula (I) are contained in at least one layer. The latter is preferably situated directly on the substrate. In the sense of the present Application, the expression "at least one layer" means that compounds of formula (I) can also be contained in a plurality of layers, can be contained in a maximum of all the layers between the substrate and the light-sensitive layer which is situated nearest to substrate, and can also be contained in other layers which may be present in addition. In a further preferred embodiment, the compounds are added to two or three layers. The compounds are added to a layer which is preferably situated directly on the substrate below the layer structure, and the compounds of formula (I) are added to a layer which is further away from the substrate than any light-sensitive layer and/or to a layer which is on the backside of the substrate.

Photographic recording materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285. Various polyester substrates are described in EP 0 601 501 A1 and in U.S. Pat. No. 5,719,015. Within the scope of the present invention, cellulose triacetate and polyesters in particular are preferably used. Polyesters in the sense of the present invention are described in EP 0 601 501.A1 and in U.S. Pat. No. 5,719,015 for example. Polyethylene glycol 2,6-naphthalate (PEN) and polyethylene glycol terephthalate (PET) are particularly preferred.

Examples of colour photographic recording materials include colour negative films and colour positive films. A review of typical colour photographic recording materials and of preferred forms thereof and processing procedures therefor is given in Research Disclosure 37038 (February 1995).

Colour photographic recording materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated for the most important products:

Colour photographic films such as colour negative films comprise, in the following sequence on their support: 2 or 3 red-sensitive, cyan-coupling silver halide emulsion layers, 2 or 3 green-sensitive, magenta-coupling silver halide emulsion layers, and 2 or 3 blue-sensitive, yellow-coupling silver halide emulsion layers. The layers of identical spectral sensitivity differ as regards their photographic speed, wherein the less sensitive partial layers are generally disposed nearer the support than are the more highly sensitive partial layers.

The options for different layer arrangements and their effects on photographic properties are described in J. Inf. Rec. Mats., 1994, Vol. 22, pages 183–193.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE 25 30 645).

The essential constituents of the photographic emulsion layer are binders, silver halide grains and colour couplers.

Information on suitable binders is given in Research Disclosure 37254, Part 2 (1995), page 286.

Information on suitable silver halide emulsions, their production, ripening, stabilisation and spectral sensitisation, including suitable spectral sensitisers, is given in Research Disclosure 36544, (September 1994), in Research Disclosure 37254, Part 3 (1995), page 286, and in Research Disclosure 37038, Part XV (1995), page 89.

Photographic materials which exhibit camera-sensitivity usually contain silver bromide-iodide emulsions, which may also optionally contain small proportions of silver chloride. Photographic copier materials contain either silver chloride-bromide emulsions comprising up to 80 mole % AgBr or silver chloride-bromide emulsions which contain more than 90 mole % AgCl.

The emulsions which are used in one preferred embodiment of the present invention are tab grain emulsions. This term should be understood to mean emulsions comprising silver halide crystals which exhibit a tabular crystal habit with an aspect ratio>2, where the aspect ratio is the ratio of the diameter of the projected circle of equivalent area to the thickness of the crystal.

Photographic emulsions can be spectrally sensitised using methine dyes or other dyes. Cyanin dyes, merocyanin dyes and complex merocyanin dyes are particularly suitable dyes. Compounds of this type, particularly merocyanins, can also be used as stabilisers.

A review of polymethine dyes which are suitable as spectral sensitisers, of suitable combinations thereof, and of combinations which exhibit a super-sensitising effect in particular, is given in Research Disclosure 17643 (1978), Section IV, and in Research disclosure 18716 (1979), page 648 (right-hand column) to page 649 (right-hand column).

Other substances which can be use as red sensitisers include pentamethine cyanins which contain naphthothiazole, naphthoxazole or benzthiazole as basic terminal groups, which are substituted with halogen, methyl or methoxy groups and which can be bridged by a 9,11-alkylene, particularly by 9,11-neopentylene, such as those described in GB 604 217 and BE 660 948. The N,N'-substituents can also be $C_4$–$C_8$ alkyl groups, as described in EP 0 532 042. In addition, the methine chain can also comprise substituents, as disclosed in EP 0 532 042. Pentamethines which only contain one methyl group on their cyclohexene ring can also be used, such as those described in EP 0 532 042. As described in BE 660 948, the red sensitiser can be super-sensitised and stabilised by the addition of heterocyclic mercapto compounds.

In addition, the red-sensitive layer can be spectrally sensitised between 390 and 590 nm, preferably at 500 nm in order thus to effect better differentiation between shades of red in accordance with EP 0 304 297, U.S. Pat. No. 806,460 and U.S. Pat. No. 5,084,374.

Compounds of this type, particularly merocyanines, can also be used as stabilisers.

Spectral sensitisers can be added in dissolved form or as a dispersion to the photographic emulsion. Both solutions and dispersions may also contain additives such as wetting agents or buffers, for example.

The spectral sensitiser or a combination of spectral sensitisers can be added before, during or after the preparation of the emulsion.

Information on customary colour couplers is to be found in Research Disclosure 37254, Part 4 (1995), page 288, and in Research Disclosure 37038, Part II (1995), page 80. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, and in Research Disclosure 37038, Part XIV (1995), page 86.

The colour photographic recording material according to the invention can additionally contain compounds which are capable of releasing a development inhibitor, a development accelerator, a bleaching accelerator, a developer, a solvent for silver halides, a fogging agent or an anti-fogging agent, for example what are termed DIR hydroquinones or other compounds such as those which are described in U.S. Pat. No. 4,636,546, U.S. Pat. No. 4,345,024 and U.S. Pat. No. 4,684,604 and in DE-A 24 47 079, DE-A 25 15 213 and DE-A 31 45 640, or in EP-A 198 438. These compounds perform the same function as DIR, DAR or FAR couplers, except that they do not form coupling products.

High molecular weight colour couplers are described in DE-C 1 297 417, DE-A 24 07 569, DE-A 31 48 125, DE-A 32 17 200, DE-A 33 20 079, DE-A 33 24 932, DE-A 33 31 743, DE-A 33 40 376, EP-A 27 284 and U.S. Pat. No. 4,080,211, for example. High molecular weight colour couplers are generally produced by the polymerisation of ethylenically unsaturated colour coupler monomers. They can also be obtained by addition polymerisation or condensation polymerisation, however.

Colour couplers can be incorporated in silver halide emulsion layers by firstly preparing a solution or a dispersion of the compound concerned and then adding the casting solution for the layer in question. The choice of a suitable solvent or dispersion medium depends on the solubility of the compound.

Methods of introducing compounds which are substantially insoluble in water by grinding processes are described in DE-A 26 09 741 and DE-A 26 09 742, for example.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The compounds can also be introduced into the casting solution in the form of what are termed filled latices. Reference is made in this respect, for example, to DE-A 25 41 230, DE-A 25 41 274, DE-A 28 35 856, EP-A 0 014 921, EP-A 0 069 671, EP-A 0 130 115 and U.S. Pat. No. 4,291,113. The diffusion-resistant incorporation of anionic, water-soluble compounds (e.g. of couplers or dyes) can also be effected with the aid of cationic polymers termed polymeric mordants.

Examples of suitable oil-formers include alkyl phthalates, esters of phosphoric acid, esters of phosphonic acid, esters of citric acid, esters of lactic acid, esters of benzoic acid, esters of fatty acids, amides, alcohols, phenols, sulphonamides, aniline derivatives and hydrocarbons.

Yellow filter dyes are usually disposed between the green-sensitive and blue-sensitive layers, to prevent blue light from reaching the layers underneath.

All the yellow filter dyes which are known from the prior art can be used according to the invention. However, compounds such as those disclosed in DE 196 46 402 are preferably used.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, and in Research Disclosure 37038, Part III (1995), page 84.

The photographic recording material may additionally contain compounds which absorb UV light, brighteners, spacers, filter dyes, formalin scavengers, light stabilisers, anti-oxidants, $D_{Min}$ dyes, additives for improving the dye-, coupler- and white stability and to reduce colour fogging, plasticisers (latices), biocides and other substances.

Suitable compounds are given in Research Disclosure 37254, Part 8 (1995), page 292, and in Research Disclosure 37038, Parts IV, V, VI, VII, X, XI and XIII (1995), pages 84 et seq.

The layers of colour photographic materials are usually hardened, i.e. the binder used, preferably gelatine, is crosslinked by suitable chemical methods.

Suitable hardener substances are described in Research Disclosure 37254, Part 9 (1995), page 294, and in Research Disclosure 37038, Part XII (1995), page 86.

After image-by-image exposure, colour photographic materials are processed by different methods corresponding to their character. Details on the procedures used and the chemicals required therefor are published in Research Disclosure 37254, Part 10 (1995), page 294, and in Research Disclosure 37038, Parts XVI to XXIII (1995), page 95 et seq., together with examples of materials.

EXAMPLES

Example 1

A colour photographic recording material for colour negative colour development was produced (layer structure 1) by depositing the following layers in the given sequence on a transparent film base of cellulose triacetate. The quantitative data are given with respect to 1 $m^2$ in each case. The corresponding amounts of $AgNO_3$ are quoted for silver halide deposition. The silver halides were stabilised with 0.5 g 4-hydroxy-6-methyl-1,3,3a,7-tetraazaindene per mole $AgNO_3$.

1st layer (anti-halo layer)

| | | |
|---|---|---|
| 0.3 | g | black colloidal silver |
| 1.2 | g | gelatine |
| 0.3 | g | UV absorber UV-1 |
| 0.2 | g | DOP (developer oxidation product) - scavenger SC-1 |
| 0.02 | g | tricresyl phosphate (TCP) |

2nd layer (low red-sensitivity layer)

| | | |
|---|---|---|
| 0.7 | g | $AgNO_3$ of an AgBrI emulsion spectrally sensitised to red, 4 mole-% iodide, average grain diameter 0.42 μm |
| 1 | g | gelatine |
| 0.35 | g | colourless coupler C-1 |
| 0.05 | g | coloured coupler RC-1 |
| 0.03 | g | coloured coupler YC-1 |
| 0.36 | g | TCP |

3rd layer (medium red-sensitivity layer)

| | | |
|---|---|---|
| 0.8 | g | $AgNO_3$ of an AgBrI emulsion spectrally sensitised to red, 5 mole-% iodide, average grain diameter 0.53 μm |
| 0.6 | g | gelatine |
| 0.15 | g | colourless coupler C-2 |
| 0.03 | g | coloured coupler RC-1 |
| 0.02 | g | DIR coupler D-1 |
| 0.18 | g | TCP |

4th layer (high red-sensitivity layer)

| | | |
|---|---|---|
| 1 | g | $AgNO_3$ of an AgBrI emulsion spectrally sensitised to red, 6 mole-% iodide, average gram diameter 0.85 μm |
| 1 | g | gelatine |
| 0.1 | g | colourless coupler C-2 |
| 0.005 | g | DIR coupler D-2 |
| 0.11 | g | TCP |

5th layer (intermediate layer)

| | | |
|---|---|---|
| 0.8 | g | gelatine |
| 0.07 | g | DOP scavenger SC-2 |

-continued

| | | |
|---|---|---|
| 0.06 | g | aluminium salt of aurin tricarboxylic acid |

6th layer (low green-sensitivity layer)

| | | |
|---|---|---|
| 0.7 | g | $AgNO_3$ of an AgBrI emulsion spectrally sensitised to green, 4 mole-% iodide, average grain diameter 0.35 μm |
| 0.8 | g | gelatine |
| 0.22 | g | colourless coupler M-1 |
| 0.065 | g | coloured coupler YM-1 |
| 0.02 | g | DIR coupler D-3 |
| 0.2 | g | TCP |

7th layer (medium green-sensitivity layer)

| | | |
|---|---|---|
| 0.9 | g | $AgNO_3$ of an AgBrI emulsion spectrally sensitised to green, 4 mole-% iodide, average grain diameter 0.50 μm |
| 1 | g | gelatine |
| 0.16 | g | colourless coupler M-1 |
| 0.04 | g | coloured coupler YM-1 |
| 0.015 | g | DIR coupler D-4 |
| 0.14 | g | TCP |

8th layer (high green-sensitivity layer)

| | | |
|---|---|---|
| 0.6 | g | $AgNO_3$ of an AgBrI emulsion spectrally sensitised to green, 6 mole-% iodide, average grain diameter 0.70 μm |
| 1.1 | g | gelatine |
| 0.05 | g | colourless coupler M-1 |
| 0.01 | g | coloured coupler YM-2 |
| 0.02 | g | DIR-coupler D-5 |
| 0.08 | g | TCP |

9th layer (yellow filter layer)

| | | |
|---|---|---|
| 0.09 | g | yellow dye GF-1 |
| 1 | g | gelatine |
| 0.08 | g | DOP scavenger SC-2 |
| 0.26 | g | TCP |

10th layer (low blue-sensitivity layer)

| | | |
|---|---|---|
| 0.3 | g | $AgNO_3$ of an AgBrI emulsion spectrally sensitised to blue, 6 mole-% iodide, average grain diameter 0.44 μm |
| 0.5 | g | $AgNO_3$ of an AgBrI emulsion spectrally sensitised to blue, 6 mole-% iodide, average grain diameter 0.50 μm |
| 1.9 | g | gelatine |
| 1.1 | g | colourless coupler Y-1 |
| 0.037 | g | DIR coupler D-6 |
| 0.6 | g | TCP |

11th layer (high blue-sensitivity layer)

| | | |
|---|---|---|
| 0.6 | g | $AgNO_3$ of an AgBrI emulsion spectrally sensitised to blue, 7 mole-% iodide, average grain diameter 0.95 μm |
| 1.2 | g | gelatine |
| 0.01 | g | colourless coupler Y-1 |
| 0.006 | g | DIR coupler D-7 |
| 0.11 | g | TCP |

12th layer (micrate layer)

| | | |
|---|---|---|
| 0.1 | g | $AgNO_3$ of a micrate-AgBrI emulsion, 0.5 mole-% iodide, average grain diameter 0.06 μm |
| 1 | g | gelatine |
| 0.4 | mg | $K_2[PdCl_4]$ |
| 0.4 | g | UV absorber UV-2 |
| 0.3 | g | TCP |

13th layer (protective and hardener layer)

| | | |
|---|---|---|
| 0.25 | g | gelatine |
| 0.75 | g | hardener H-1 |

After hardening, the layer structure as a whole exhibited a swelling factor ≦3.5.

Substances used in Example 1:
UV-1
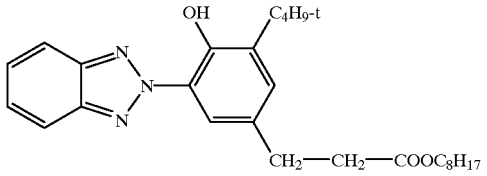
UV-2
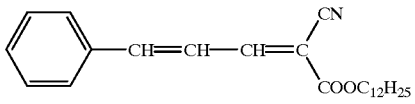
C-1
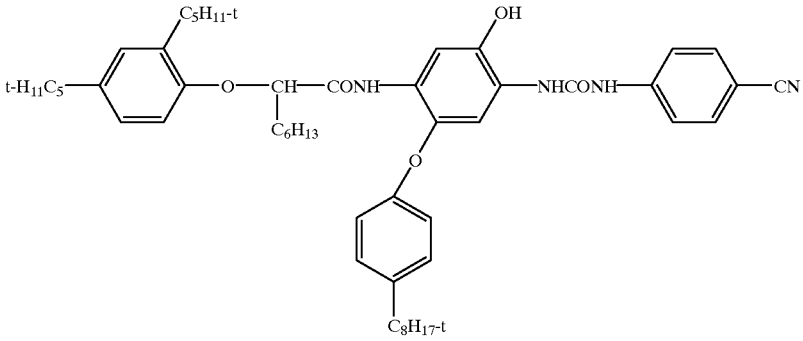
C-2
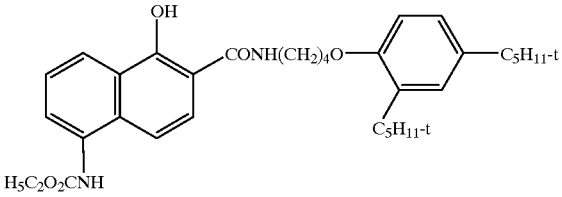
RC-1
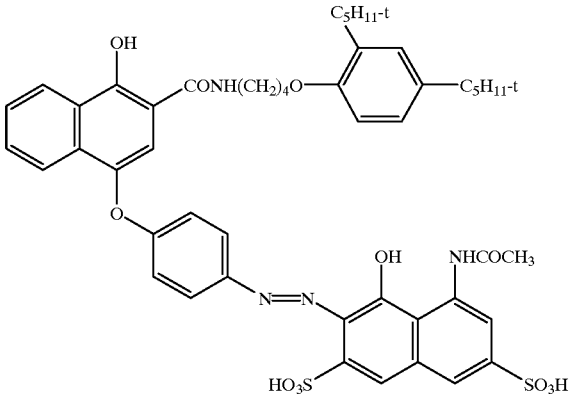
YC-1
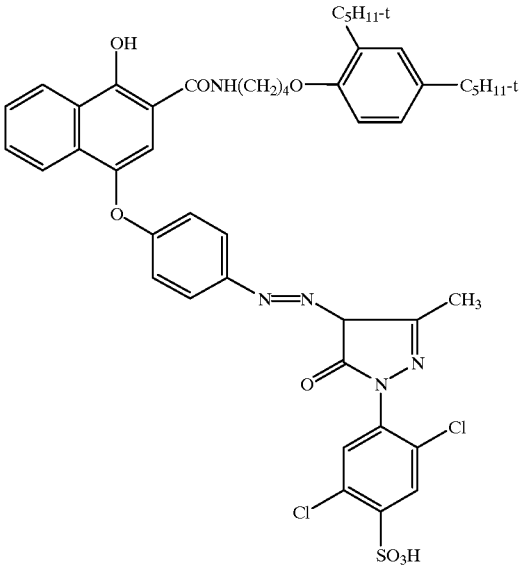
M-1
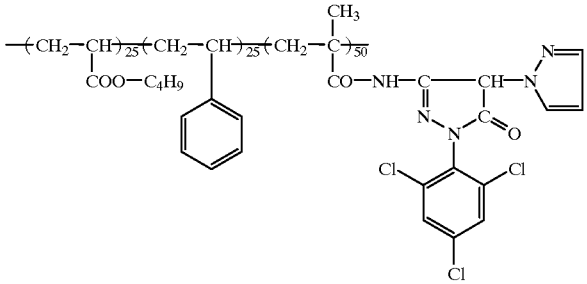

-continued
M-2
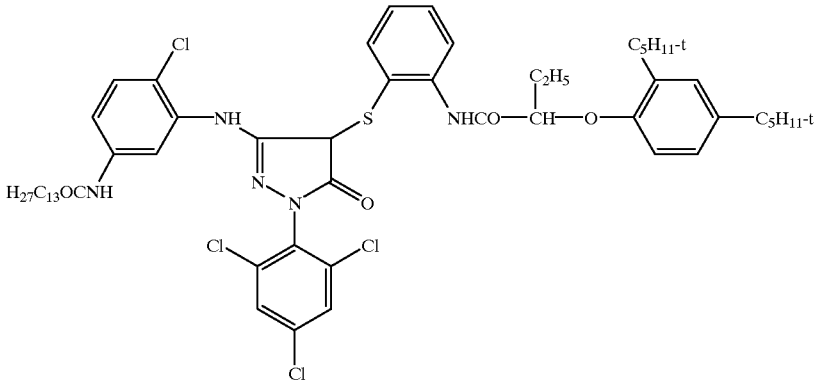
YM-1
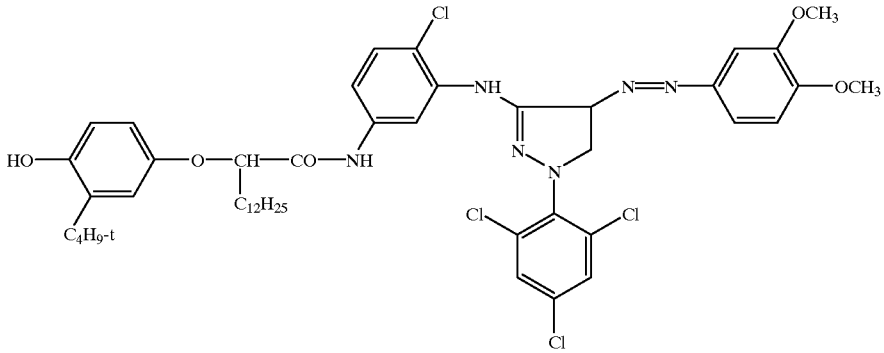
YM-2
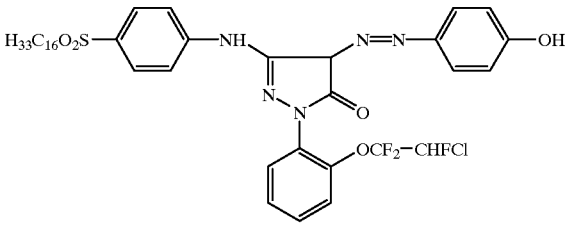
Y-1
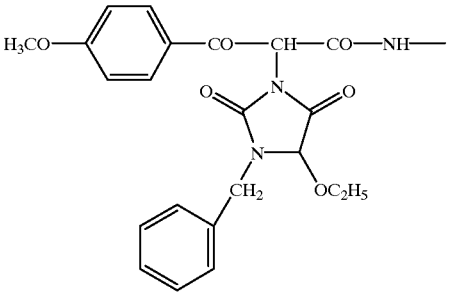
D-1
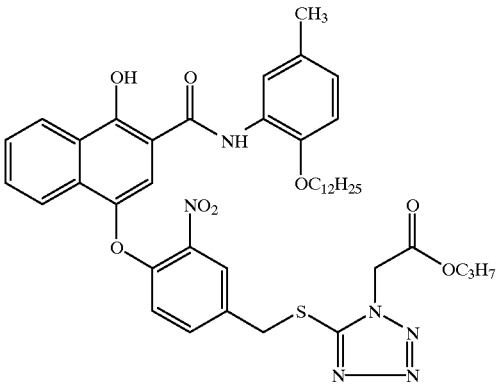
D-2
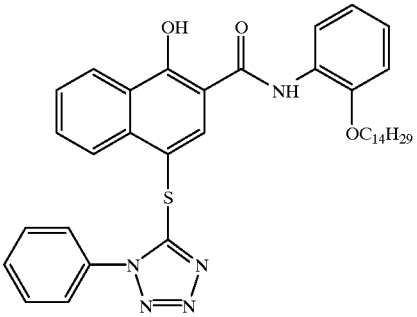

-continued
D-3
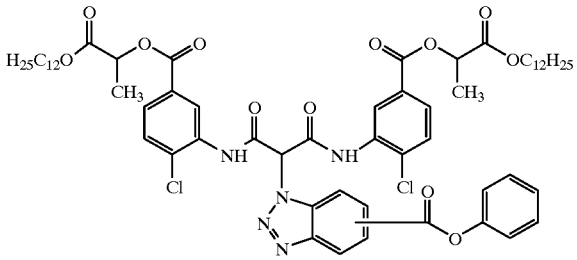
D-4
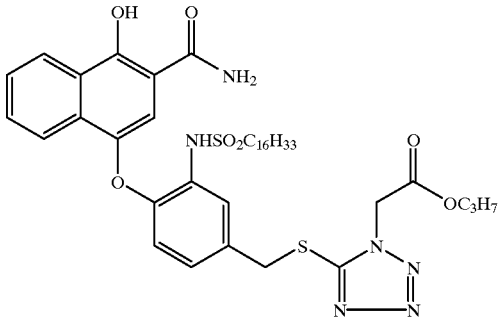
D-5
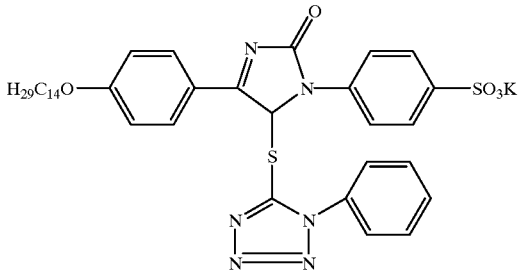
D-6
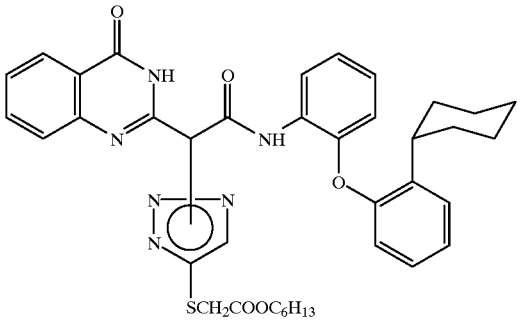
D-7
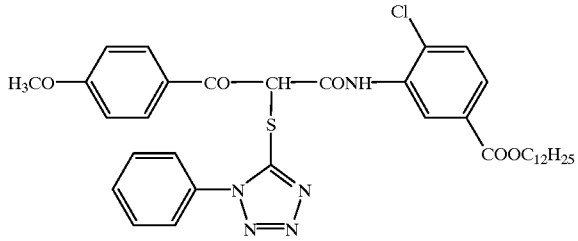
SC-1
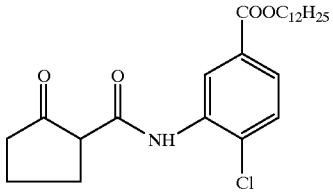
SC-2
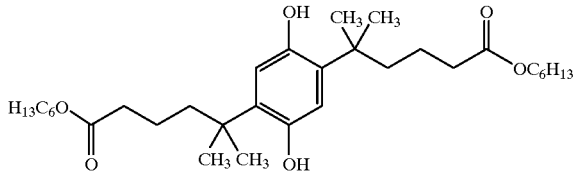
GF-1
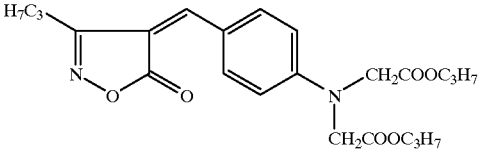
GF-2
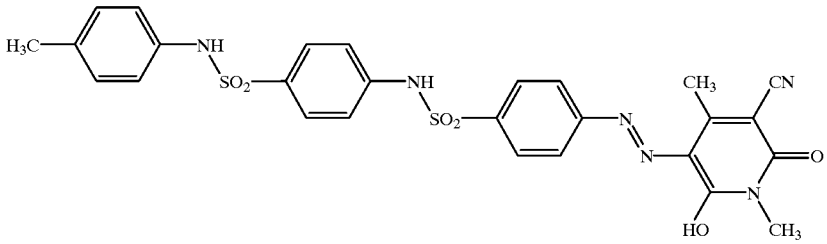
H-1
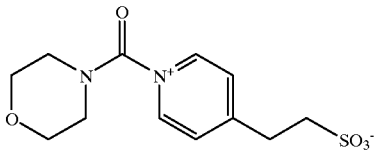

After exposing a neutral wedge, development was effected as described in the British Journal of Photography, 1974, pages 597 and 598.

Structures 2 to 13 differed from structure 1, as shown in the Table. The additional layer 1a was situated between the substrate and layer 1.

| Mat. | | Film base[1] | Yellow filter dye | Compound layer la/amount g/m$^2$ | Dmin yellow | Blue-green colour separation[2] (relative E spacing) | δ D(green[3]) after storage for 4 weeks. Exposed at an initial density Dmin + 1.0 | Relative green-sensitivity Fresh | Storage for 2 months | Storage for 4 months | Storage for 6 months | Storage for 8 months | Storage for 10 months |
|---|---|---|---|---|---|---|---|---|---|---|---|---|---|
| 1 | Comparison | CTA | GF4 | — | 0.86 | 11.4 | −0.14 | 10.0 | 10.1 | 10.1 | 10.1 | 10.0 | 9.9 |
| 2 | Comparison | CTA | none | — | 0.85 | 7.7 | −0.16 | 11.1 | 11.1 | 11.1 | 10.9 | 11.0 | 10.9 |
| 3 | Comparison | CTA | GF-2 | — | 1.02 | 10.5 | −0.15 | 9.2 | 9.2 | 9.1 | 9.1 | 9.0 | 8.9 |
| 4 | Comparison | PEN | GF-1 | — | 1.03 | 11.3 | −0.15 | 9.8 | 9.5 | 9.4 | 9.1 | 9.0 | 8.8 |
| 5 | Comparison | PEN | none | — | 1.02 | 7.9 | −0.16 | 11.1 | 11.0 | 11.1 | 10.9 | 11.0 | 10.9 |
| 6 | Comparison | PEN | GF-2 | — | 1.19 | 10.5 | −0.16 | 9.1 | 9.0 | 9.1 | 9.0 | 8.9 | 8.9 |
| 7 | Comparison | PET | GF-1 | — | 0.85 | 11.5 | −0.13 | 10.1 | 9.6 | 9.4 | 9.2 | 9.0 | 8.9 |
| 8 | Comparison | PET | none | — | 0.84 | 7.6 | −0.14 | 11.0 | 11.0 | 11.1 | 10.9 | 10.9 | 10.8 |
| 9 | Comparison | PET | GF-2 | — | 1.03 | 10.5 | −0.14 | 9.2 | 9.2 | 9.0 | 9.1 | 9.0 | 8.9 |
| 10 | Invention | CTA | GF-1 | I-4/0.40 | 0.85 | 11.4 | 0.01 | 10.1 | 10.1 | 10.0 | 10.1 | 9.9 | 10.0 |
| 11 | Invention | PEN | GF-1 | I-1/0.30 | 1.02 | 11.4 | −0.07 | 9.9 | 9.9 | 9.9 | 9.8 | 9.8 | 9.7 |
| 12 | Invention | PET | GF-1 | I-1/0.30 | 0.85 | 11.4 | −0.06 | 9.9 | 10.1 | 10.0 | 9.8 | 9.8 | 9.7 |
| 13 | Invention | PEN | GF-1 | I-2/0.60 | 1.02 | 11.5 | −0.01 | 10.0 | 10.0 | 10.1 | 10.0 | 10.0 | 10.0 |
| 14 | Invention | PEN | GF-1 | I-3/0.25 | 1.03 | 11.5 | −0.02 | 10.1 | 10.0 | 10.1 | 9.9 | 10.0 | 9.9 |
| 15 | Invention | PEN | GF-1 | I-4/0.40 | 1.02 | 11.4 | 0.00 | 10.0 | 10.0 | 10.1 | 10.0 | 9.9 | 10.0 |
| 16 | Invention | PET | GF-1 | I-4/0.40 | 0.86 | 11.4 | 0.01 | 10.0 | 10.0 | 9.9 | 10.1 | 10.0 | 9.9 |
| 17 | Invention | PEN | GF-1 | I-5/0.35 | 1.03 | 11.6 | −0.03 | 9.9 | 9.9 | 9.8 | 9.8 | 9.7 | 9.7 |
| 18 | Invention | PEN | GF-1 | I-6/0.33 | 1.02 | 11.4 | −0.03 | 10.1 | 9.9 | 9.9 | 9.8 | 9.8 | 9.7 |
| 19 | Invention | PEN | GF-1 | I-7/0.29 | 1.02 | 11.5 | −0.01 | 10.1 | 10.0 | 10.0 | 9.9 | 9.8 | 9.9 |

[1]CTA = cellulose triacetate; PBN = polyethylene glycol-2,6-naphthalate; PET = polyethylene glycol terephthalate
[2]Blue-green colour separation = $(E_B - E_G)^B - (E_B - E_G)^W$; $E_X$ = sensitivity of the layer for X, B = blue, G = green; $(\ldots)^X$ = exposure X, B = blue, W = white
[3]Measured using Status M green filter, see James, the Theory of the Photographic Process, 4th Edition, Part II, page 521.

As can be seen from the Table, the materials according to the invention exhibit good storage stability under normal conditions and good decolorising capacity of the yellow filter dye (low Dmin yellow), with a good blue-green colour separation.

What is claimed is:

1. A color photographic recording material which comprises a substrate and on said substrate at least one red-sensitive silver halide emulsion layer comprising a cyan coupler, at least one green-sensitive silver halide emulsion layer comprising a magenta coupler, at least one blue-sensitive silver halide emulsion layer comprising a yellow coupler, and at least one yellow colored, light-insensitive layer (yellow filter layer) which is disposed below a blue-sensitive silver halide emulsion layer and above a green-sensitive silver halide emulsion layer, wherein the material contains, in at least one layer between the substrate and the light-sensitive emulsion layer situated nearest to the substrate, a compound of formula (I)

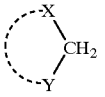

(I)

wherein

X and Y, independently of each other in each case, represent an electron-attracting group, which may be connected to each other to form a 5- or 6-membered ring.

2. The color photographic recording material according to claim 1, wherein the compound of formula I is a compound of formulae Ia or Ib (Ia)

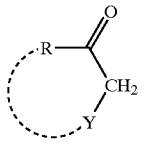

(Ib)

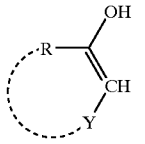

wherein

Y represents an electron-attracting group, and

R represents alkyl, aryl, alkoxy, aryloxy, alkylamiono, arylamino or together with Y represents a group for the completion of a 5- or 6-membered ring (hetero)cycle.

3. The color photographic material according claim 1, wherein X and Y, independently of each other in each case, represent an electron-attracting group, and X and Y together form a group which is necessary for the completion of a 5- or 6-membered ring.

4. The color photographic recording material according to claim 1, wherein the compound of formula (I) is in at least one layer directly adjacent to the substrate.

5. The color photographic recording material according to claim 1, wherein the compound of formula (I) is in at least one additional layer.

6. The color photographic material according claim 1, wherein the compound of formula (I) is additionally in a layer which is further away from the substrate than any light-sensitive layer and/or to a layer which is on the backside of the substrate.

7. The color photographic recording material according to claim 1, wherein the compound of formula (I) is used in an amount from 0.1 to 2 mmole/$m^2$.

8. The color photographic recording material according to claim 1, wherein said substrate is a polyester substrate.

9. The color photographic recording material according to claim 1, wherein the substrate is a polyethylene glycol 2,6-naphthalate substrate or a polyethylene glycol terephthalate substrate.

10. The color photographic recording material according to claim 1, wherein the compound of formula (I) is selected from the group consisting of (I-1)

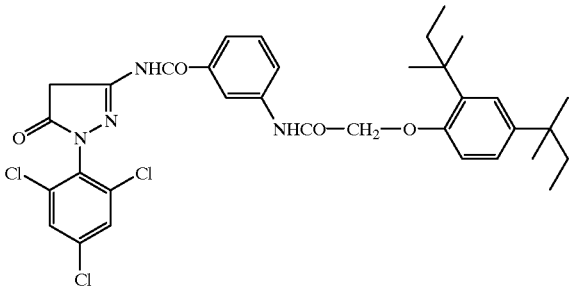

(I-2)

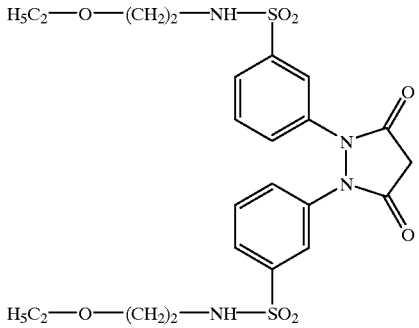

(I-3)

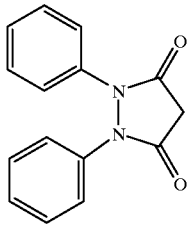

(I-4)

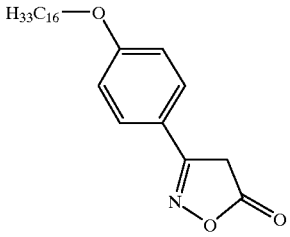

(I-5)

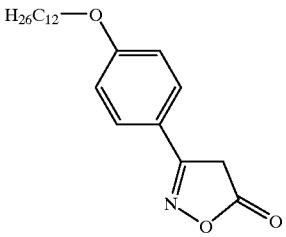

(I-6)

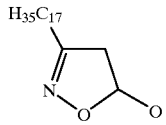

-continued
(I-7)
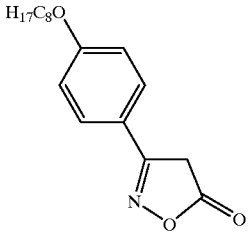
(I-8)
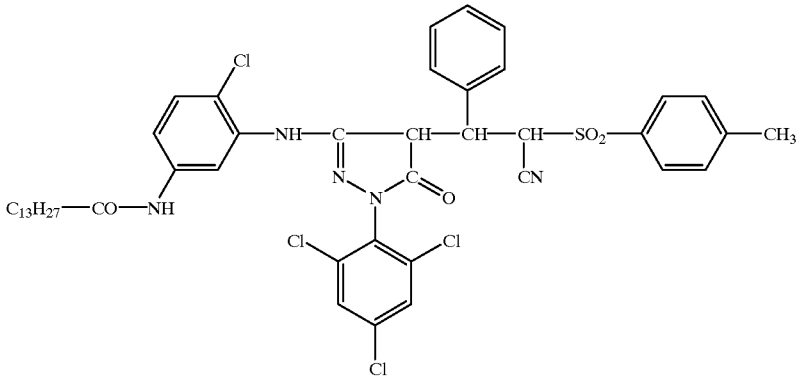
(I-9)
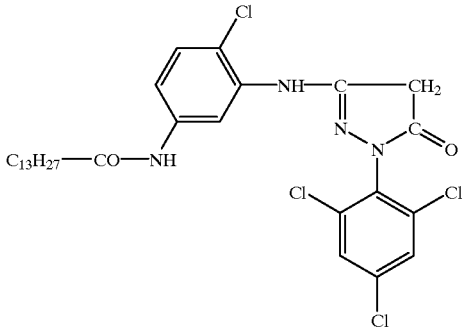
(I-10)
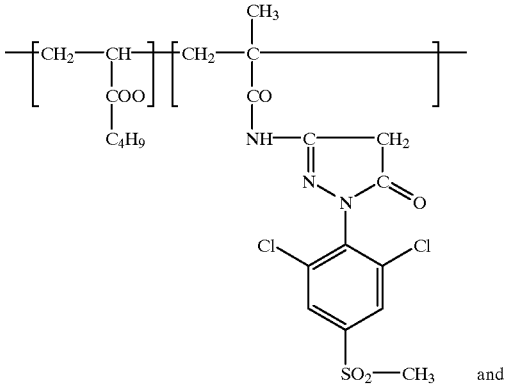
80% 20%
and
(I-11)
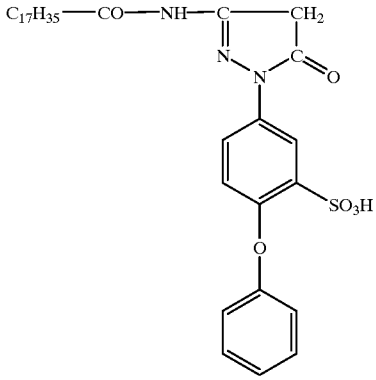

11. The color photographic recording material according to claim 1, wherein the compound of formula (1) is used in an amount from 0.01 to 10 mmole/$m^2$.

12. The color photographic recording material according to claim 2, wherein Y is R'CO—, R'R"NCO—, NC—, R'$SO_2$—, R'OCO— or R'R"$NSO_2$ and wherein R' and R", independently of one another, are alkyl, aryl, aryloxy, alkoxy, alkylamino or arylamino.

13. The color photographic recording material according to claim 1, wherein X and Y, independently of each other, represent R'CO—, R'R"NCO—, NC—, R'$SO_2$—, R'OCO— or R'R"$NSO_2$ and wherein R' and R", independently of one another, are alkyl, aryl, aryloxy, alkoxy, alkylamino or arylamino.

* * * * *